US008558148B2

(12) United States Patent
Artigas Maestre et al.

(10) Patent No.: US 8,558,148 B2
(45) Date of Patent: Oct. 15, 2013

(54) INDUCTION HOB COMPRISING A PLURALITY OF INDUCTION HEATERS

(75) Inventors: Jose Ignacio Artigas Maestre, Saragossa (ES); Luis Angel Barragan Perez, Saragossa (ES); Ignacio Garde Aranda, Saragossa (ES); Pablo Jesus Hernandez Blasco, Cuarte de Huerva (ES); Denis Navarro Tabernero, Zuera (ES); Daniel Palacios Tomas, Saragossa (ES); Ramon Peinado Adiego, Saragossa (ES)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 246 days.

(21) Appl. No.: 12/811,553

(22) PCT Filed: Jan. 12, 2009

(86) PCT No.: PCT/EP2009/050274

§ 371 (c)(1),
(2), (4) Date: Jul. 2, 2010

(87) PCT Pub. No.: WO2009/090152

PCT Pub. Date: Jul. 23, 2009

(65) Prior Publication Data

US 2010/0282740 A1 Nov. 11, 2010

(30) Foreign Application Priority Data

Jan. 14, 2008 (ES) ..... 200800175

(51) Int. Cl.
*H05B 6/06* (2006.01)

(52) U.S. Cl.
USPC ..... 219/662; 219/664; 219/670; 219/626

(58) Field of Classification Search
USPC ..... 219/622, 625, 626, 662–664, 670–672
See application file for complete search history.

(56) References Cited

U.S. PATENT DOCUMENTS

| | | | | |
|---|---|---|---|---|
| 5,523,631 | A * | 6/1996 | Fishman et al. | 307/38 |
| 2007/0164017 | A1 * | 7/2007 | Gouardo et al. | 219/626 |
| 2009/0008384 | A1 | 1/2009 | Roux | |
| 2009/0086519 | A1 * | 4/2009 | Sadakata et al. | 363/131 |
| 2009/0139986 | A1 * | 6/2009 | Lee et al. | 219/622 |

FOREIGN PATENT DOCUMENTS

JP 2001-196156 A 7/2001

* cited by examiner

*Primary Examiner* — Thao Le
*Assistant Examiner* — Sheng Zhu
(74) *Attorney, Agent, or Firm* — James E. Howard; Andre Pallapies

(57) ABSTRACT

An induction hob having a plurality of induction heating elements; a control unit to operate the plurality of induction heating elements so as to heat at least one flexibly definable heating zone in a synchronized manner; and a measurement array to measure a heating power generated by the plurality of induction heating elements. The measurement array measures a sum of heating powers of at least two induction heating elements and the control unit uses the sum of heating powers to regulate the heating power generated by the plurality of induction heating elements.

29 Claims, 4 Drawing Sheets

INDUCTION HOB COMPRISING A PLURALITY OF INDUCTION HEATERS

BACKGROUND OF THE INVENTION

The invention relates to an induction hob having a plurality of induction heating elements and a method for operating an induction hob.

What are known as matrix induction hobs with a plurality of induction heating elements are known from the prior art, the induction heating elements being disposed in a grid or matrix. The comparatively small induction heating elements can be combined flexibly to form essentially freely definable heating zones. A control unit of the induction hob can detect cooking utensil elements and combine the induction heating elements that are covered at least to some degree by a base of the detected cooking utensil element to form a heating zone assigned to the detected cooking utensil element and operate them in a synchronized manner. Such induction hobs comprise a measurement array which the control unit can use to capture characteristic variables for a power of the individual induction heating elements and to regulate the power to a setpoint value. Such a characteristic variable may be for example a resistance, a current and/or an impedance of the induction heating element, the electrical characteristics of which are influenced by the cooking utensil element.

Since the induction heating elements are operated with high-frequency currents compared with grid voltage, it is complex to measure and evaluate the signals of the measurement array and it is cost-intensive to provide the sensor system for each individual induction heating element.

BRIEF SUMMARY OF THE INVENTION

The object of the invention is in particular to provide a generic induction hob that can be controlled with a less complex control algorithm. The object of the invention is also to reduce the required computation capacity of a control unit of such an induction hob and to simplify a measurement array of such an induction hob. A further object of the invention is to simplify a method for operating such an induction hob.

The invention is based on an induction hob having a plurality of induction heating elements, a control unit, which is designed to operate a number of induction heating elements of a flexibly definable heating zone in a synchronized manner, and a measurement array for measuring a heating power generated by the induction heating elements.

It is proposed that the measurement array is designed to measure a sum of heating powers of at least two induction heating elements. The control unit should also be designed to use the sum of the heating powers to regulate the heating power. The control unit and the measurement array can be "designed" to carry out their tasks by means of suitable software, suitable hardware or by a combination of these two factors.

The invention is based in particular on the fact that in modern matrix induction hobs adjacent induction heating elements are generally assigned to the same heating zone. Capturing the individual heating powers is then unnecessary, complicating the control operation unnecessarily and wasting computation capacity. This is even more the case, the smaller the induction heating elements or the narrower the grid of the matrix induction hob, since the proportion of induction heating elements at the edge of the heating zone decreases with the size of the grid. Also by measuring the sums of the heating powers of groups of induction heating elements it is possible to reduce the number of sensors required. If for example a current is used as the characteristic variable for the heating power, only one current sensor or ammeter has to be used for each group of heating elements.

According to one development of the invention it is proposed that the measurement array should comprise a current sensor for measuring a sum of currents flowing through the at least two induction heating elements. It is generally possible, if the at least two induction heating elements are assigned to the same heating zone, to determine from this a sufficiently precise feedback variable to regulate the power of the heating zone. The complexity of the control circuit rhythm can be reduced considerably and the number of current sensors required can be reduced.

If the hob comprises a plurality of driver units assigned respectively to an induction heating element and each having an inverter to generate a high-frequency current to operate an induction element, a high-frequency measurement can be avoided, if the measurement array is designed to measure a sum of input powers of the driver units. The input currents are generally currents with the grid frequency of for example 50 Hertz of a household power grid and can therefore be measured using particularly simple and economical standard sensor arrangements.

It is also proposed that the measurement array should be designed also to measure the values of the currents flowing through the individual induction heating elements. These currents can be used as control variables for example in exceptional instances, in which knowledge of the individual heating powers of the induction heating elements is required, or can be used as safety limiters for the powers of the induction heating elements and/or the driver units. In particular the control unit can use the currents of the individual induction heating elements to limit the inverter power.

According to a further embodiment of the invention it is proposed that the control unit should be designed to use the sum of the heating powers to regulate the heating power, if the at least two induction heating elements are assigned to a common heating zone, and to use the values of the currents of the individual induction heating elements to regulate the heating power of said induction heating elements, if the at least two induction heating elements are assigned to different heating zones. This insures reliable regulation of the heating powers in each of such instances, at the same time avoiding the capturing and processing of unnecessary data and measurement values.

The inventive combination of two induction heating elements in respect of power measurement can be used advantageously in particular if the two combined induction heating elements are adjacent induction heating elements in a matrix of induction heating elements. The measurement array and data processing in the control unit can be simplified further, if the measurement array is designed to measure a sum of the heating powers of at least four adjacent induction heating elements. Naturally it is also possible to combine six, eight or any other number of induction heating elements to form a group.

It is also proposed that the control unit should be designed to form a heating zone from a number of groups of induction heating elements and to supply each of the groups from a different inverter. The control unit can then use the input currents of the inverters as the characteristic variable for the sum of the heating powers of the induction heating elements supplied by the relevant inverter so that in this instance too power regulation is permitted without measuring the high-frequency heating currents.

If the control unit is designed to operate a number of groups of induction heating elements with a single inverter in at least one operating state, it is still possible to determine the heating power of the individual groups. To this end the control unit can determine the proportion of the overall heating power contributed by one of the groups in a phase in which only the induction heating elements of this group are active.

In one development of the invention it is proposed that the control unit should be designed to operate a number of groups of induction heating elements simultaneously with one inverter in at least one operating state.

Different heating powers of different groups can be achieved in a simple manner if the control unit is designed to operate a number of groups of induction heating elements with a single inverter and to generate the different heating powers by means of a short-term periodic deactivation of at least one induction heating element.

A further aspect of the invention relates to a method for operating an induction hob having a plurality of induction heating elements, which are grouped flexibly to form a heating zone. A heating power generated by the induction heating elements is measured here and used to regulate the operation of the induction heating elements.

According to the invention it is proposed that a sum of heating powers of at least two induction heating elements be measured and used as the control variable for operating the at least two induction heating elements.

BRIEF DESCRIPTION OF THE DRAWINGS

Further advantages will emerge from the description of the drawing that follows. The drawing shows an exemplary embodiment of the invention. The drawing, description and claims contain numerous features in combination. The person skilled in the art is advised also to consider the features individually and combine them in expedient further combinations.

In The Drawing

DETAILED DESCRIPTION OF EXEMPLARY EMBODIMENTS OF THE PRESENT INVENTION

Figure 1:
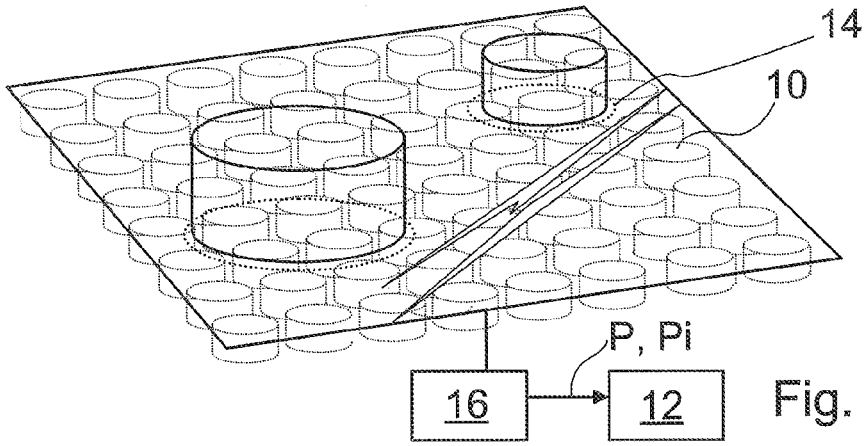
FIG. 1 shows an induction hob having a matrix of induction heating elements.

FIG. 1 shows an induction hob having a plurality of induction heating elements 10, which can be combined by a control unit 12 into groups of flexibly definable heating zones 14 and operated in a synchronized manner. The control unit 12 communicates with a measurement array 16 of the induction hob, by way of which the control unit 12 can capture characteristic variables for a heating power P, Pi generated by the induction heating elements 10*a*, 10*b*. These characteristic variables include currents, voltages and/or the electric loss angles or impedances, which can be picked up as measurement values by the measurement array 16 at different points on the induction hob.

Figure 2:
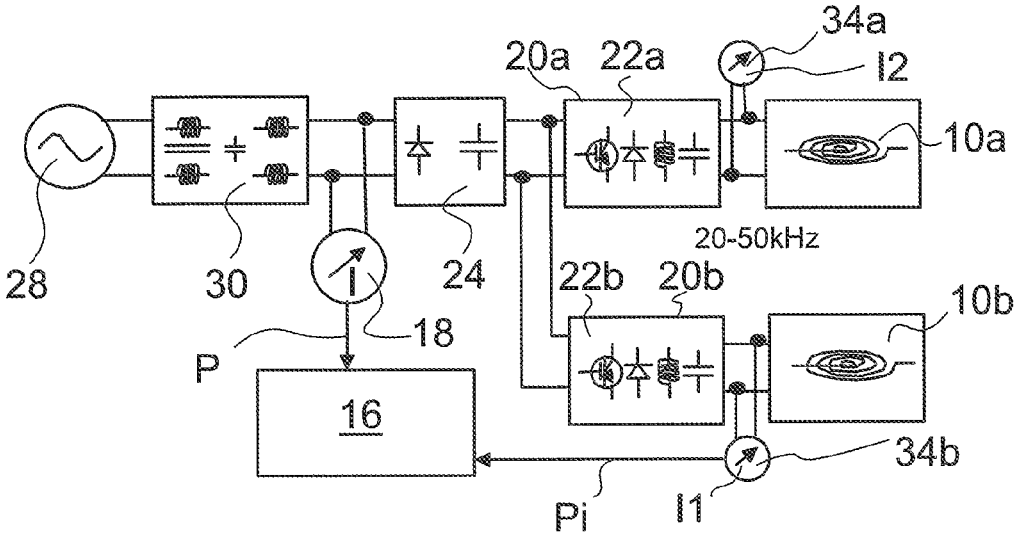
FIG. 2 shows a schematic diagram of the operation of a pair of induction heating elements.

The measurement array 16 is designed to measure a sum of heating powers P of at least two induction heating elements 10*a*, 10*b* combined to form a group by means of a common current sensor 18 (see FIG. 2). While in specific exemplary embodiments of the invention the group of induction heating elements, the heating power of which is measured in sum, may comprise four or more induction heating elements, in the schematic diagram in FIG. 2 only two induction heating elements 10*a*, 10*b* are shown for reasons of clarity.

Each of the induction heating elements 10*a*, 10*b* has a driver unit 20*a*, 20*b* assigned to it, in each instance comprising an inverter 22*a*, 22*b*. The inverter 22*a*, 22*b* uses a direct current, which is generated by a rectifier 24 and has a voltage profile illustrated in a diagram 26 in FIG. 2, to generate a heating current 11, 12 that is high-frequency compared with a grid frequency of a household power grid 28 to operate the induction heating elements 10*a*, 10*b*. A filter 30 is disposed between the household power grid 28 and the rectifier 24 to prevent damage to the induction hob by current surges from the household power grid 28.

A diagram 32 shows a voltage profile of the heating current 11, 12, which has a frequency of 20 to 50 kHz and an envelope curve that oscillates with the grid frequency as a function of a setpoint heating power of the heating zone 14.

The current sensor 18 can be disposed for example between the filter 30 and the rectifier 24, so that it essentially measures the low-frequency alternating current from the household power grid 28 with a grid frequency of 50 Hertz.

The measurement array 16 with the current sensor 18 therefore measures a sum P of input powers of the driver units 20*a*, 20*b*. The input current I of the rectifier 24 is used as the characteristic variable for the input powers.

Further current sensors 34*a*, 34*b* of the measurement array 16 serve to measure the currents I1, I2, which flow through the induction heating elements 10*a*, 10*b*. The currents I1, 12 are therefore the actual heating currents of the induction heating elements 10*a*, 10*b*. If both induction heating elements 10*a*, 10*b* are assigned to the same heating zone 14 and are completely covered by a pot base of a cooking utensil element disposed on the heating zone 14, the currents I1, I2 are at least essentially identical and can be calculated in a very good approximation as a predetermined fraction of the input current I of the rectifier 24.

The control unit 12 generally only uses the currents I1, I2 of the individual induction heating elements 10*a*, 10*b* measured by the current sensors 34*a*, 34*b* to protect the inverters 22*a*, 22*b* and to detect the cooking utensil elements on the induction hob. In normal operation the signals received from the current sensors 34*a*, 34*b* do not have to undergo complex signal processing so the complexity of the tasks of the control unit 12 can be reduced considerably compared with conventional induction hobs.

To limit the inverter power the amplitudes of the currents I1, I2 only have to be compared with one threshold value.

The control unit 12 comprises a freely programmable processor and an operating program that implements a cooking utensil detection method periodically or for the first time after a start signal from the user. The control unit 12 here detects the size and position of cooking utensil elements placed on the induction hob or on a cover plate of the induction hob and combines induction heating elements 10 that are covered at least to a certain degree by the cooking utensil element to form a heating zone 14.

The control unit 12 regulates a heating power of the heating zone 14 as a function of a heat setting set by a user to a setpoint value that is a function of the heat setting. To this end it forms a sum of the heating powers of the individual induction heating elements 10 and compared this sum with the setpoint value.

When forming the sum the control unit 12 uses the sum signal of the current sensor 18, if all the induction heating elements 10, the heating power of which is measured in a common manner by the current sensor 18, are associated with the heating zone 14. Otherwise the control unit 12 uses the current sensors 34*a*, 34*b* to determine the individual heating powers Pi.

If only some of the heating elements 10 combined by the current sensor 18 to form a group are assigned to a heating zone 14 and the remaining induction heating elements are not operated, the control unit 12 also uses the signal of the current sensor 18 to determine the heating power. Compared with groups of induction heating elements that are associated completely with the heating zone 14, the setpoint heating power of this group that influences regulation is reduced by a factor corresponding to the proportion of active induction heating elements.

The induction hob described above or the control unit 12 implements a method for operating an induction hob having a plurality of induction heating elements 10*a*, 10*b*, which can be grouped and combined flexibly to form a heating zone 14. A heating power generated by the induction heating elements 10*a*, 10*b* is measured and used to regulate the operation of the induction heating elements 10*a*, 10*b*.

The control unit 12 here captures a sum of heating powers of a group of induction heating elements 10*a*, 10*b* and normally uses this sum as a control variable for operating the group of induction heating elements 10*a*, 10*b*. In special instances, where induction heating elements 10*a*, 10*b* are assigned to different heating zones 14, the heating currents of the individual induction heating elements 10*a*, 10*b* are also included in the control method as control parameters.

Figure 3:
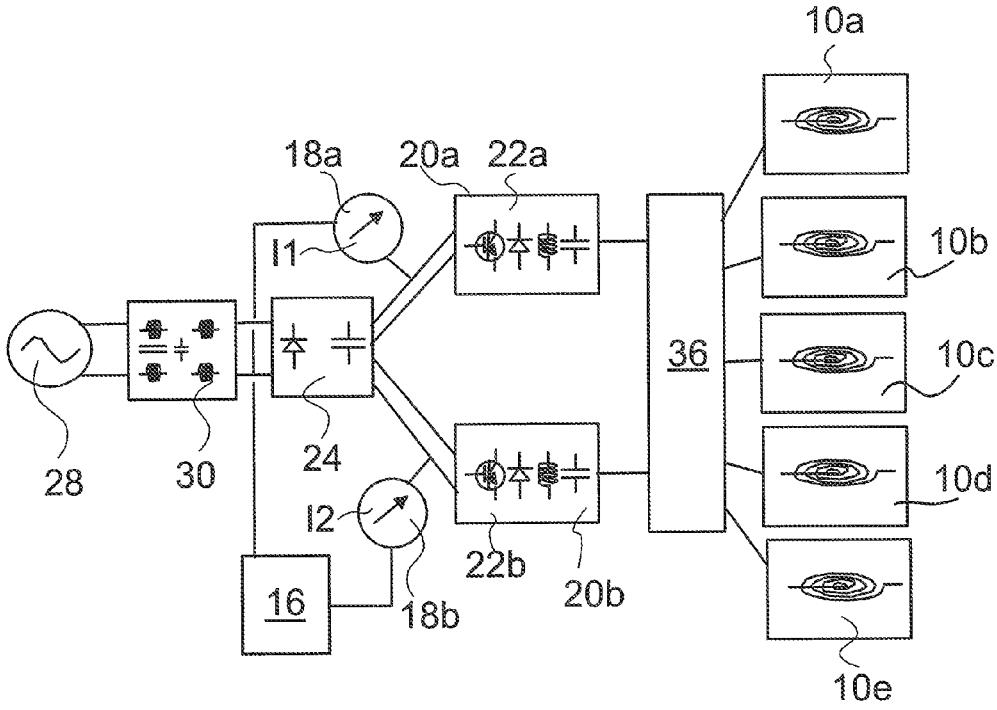
FIG. 3 shows a schematic diagram of a matrix hob having a number of inverters.

FIG. 3 shows a schematic diagram of a matrix hob with two inverters 22*a*, 22*b*, which can be connected by way of a switching arrangement 36 to induction heating elements 10*a*-10*e*. The hob comprises a matrix of induction heating elements 10*a*-10*e*, of which only five are shown by way of example in FIG. 3. It is possible to achieve a satisfactory local resolution in the definition of the heating zones 14 at reasonable cost and with an acceptable control outlay, if the actual number of induction heating elements 10*a*-10*e* is between 40 and 64.

The switching arrangement 36 can connected at least some of the induction heating elements 10*a*-10*e* optionally with one of the two inverters 22*a*, 22*b* or each of the inverters 22*a*, 22*b* to selectable groups of induction heating elements 10*a*-10*e*.

In the exemplary embodiment illustrated in FIG. 3 each of the inverters 22*a*, 22*b* is equipped with a current sensor 18*a*, 18*b*, which is disposed between a rectifier 24 and the respective inverter 22*a*, 22*b*. The current sensors 18*a*, 18*b* measure the rectified current from the household power grid 28, the relevant frequency components of which are maximum approximately 100 Hz. The low frequencies mean that current measurements of the input current of the inverters 22*a*, 22*b* are simpler than current measurements of the output currents of the inverters 22*a*, 22*b*, the frequency of which is around 75 kHz.

Figure 4:
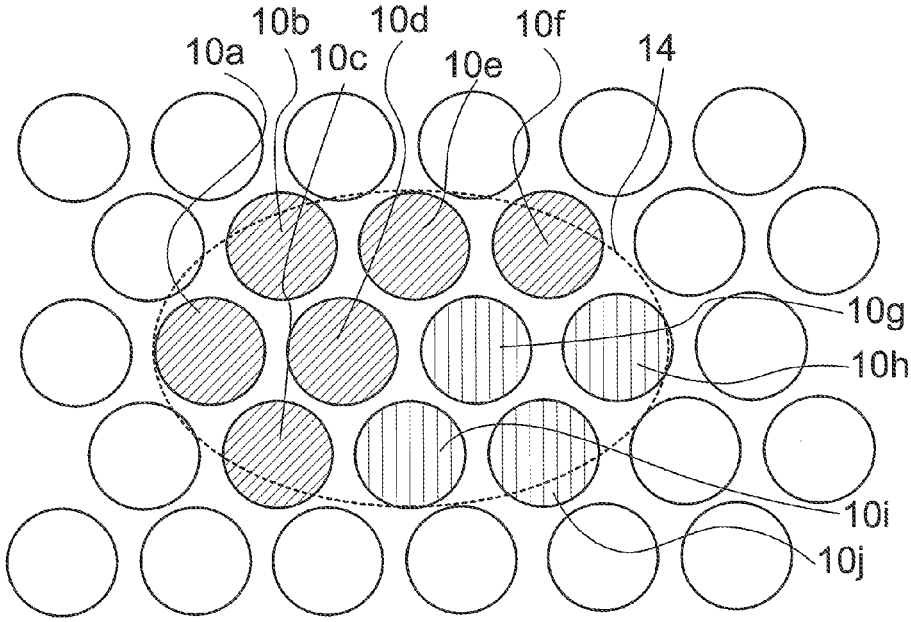
FIG. 4 shows a schematic diagram of a heating zone having a number of groups of inductors, which are supplied by different inverters.

FIG. 4 shows a schematic diagram of a heating zone 14, which is formed by nine induction heating elements 10*a*-10*i*. A first group of induction heating elements 10*a*-10*c* is supplied by a first inverter 22*a* and a second group of induction heating elements 10*d*-10*i* is supplied by a second inverter 22*b*.

When the user inputs a certain heat setting for the heating zone 14 by way of a user interface, the control unit 12 calculates a setpoint overall heating power for the heating zone 14 as a function of the set power setting and as a function of the size of the heating zone 14. The control unit 12 regulates the heating power of the heating zone 14 to the thus specified setpoint value. To this end the control unit 12 uses the input currents I1, I2 of the inverters 22*a*, 22*b*, which are measured by way of the current sensors 18*a*, 18*b*, to calculate an overall heating power of the two groups of induction heating elements 10*a*-10*i* and calculates the overall heating power of the heating zone 14 by isolating the heating powers of the groups.

If the overall heating power thus specified does not correspond to the setpoint heating power, the heating power can be regulated to the setpoint value by varying the heating frequency generated by the inverters 22*a*, 22*b* in a closed control circuit.

In one particularly simple embodiment of the invention the heating elements 10*a*-10*j* of the two groups are operated respectively with heating currents at the same frequency. The group heating powers of the two groups are then set automatically to a value, which is determined by the coupling strength of the different induction heating elements 10*a*-10*j* to the base of the cooking pot. The control unit 12 can monitor the heating power of the individual induction heating elements 10*a*-10*j* with the aid of limiting current sensors of the type illustrated in FIG. 2. If an imbalance results between the group heating powers of the two groups, the control unit can switch the switching arrangement 36 to assign one of the induction heating elements 10*a*-10*j* to the other group.

It is also possible, for example by clocked operation of the heating elements 10*a*-10*j*, to regulate the proportions of the overall heating power represented by the group heating powers to predefined values. To this end the control unit 12 can actuate the switching arrangement 36 to operate the induction heating elements 10*a*-10*i* of one of the groups in a clocked manner, or the inverters 22*a*, 22*b* can generate heating currents with different heating frequencies.

Figure 5:
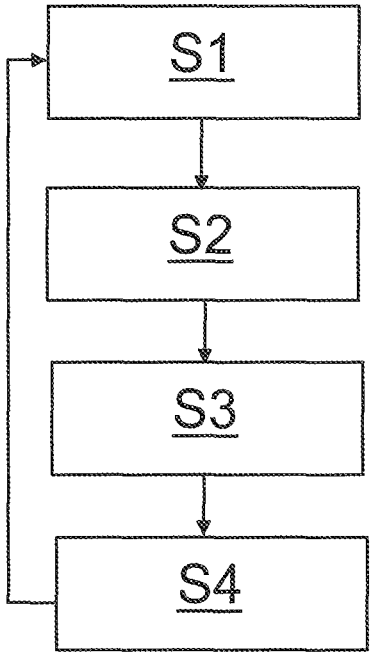
FIG. 5 shows a flow diagram of a method for distributing an overall heating power to the inverters in the situation shown in FIG. 4.

FIG. 5 shows a flow diagram of a method for distributing an overall heating power to the inverters in the situation illustrated in FIG. 4. In a step S1 a ratio of the group heating powers of different groups of heating elements, which together form a heating zone 14, is calculated. It can be determined for example that a first group of induction heating elements 10*a*-10*i* is to generate 70% of the overall heating power and that a second group of induction heating elements 10*a*-10*i* is to generate 30% of the overall heating power. This distribution can be selected for example so that the base of the cooking utensil is heated as homogeneously as possible. It is also possible for the surface components of the cooking utensil base assigned to the different groups of induction heating elements 10*a*-10*i* to be determined or estimated by the control unit 12 and the overall heating power to be distributed in proportion to the surface components. The control unit 12 can use the input currents I1, I2 of the two inverters 22*a*, 22*b* at any time to determine the group heating power of the two groups and regulate it to the setpoint value that corresponds to the predetermined proportion of the overall heating power.

The group heating powers can be set by changing the frequency of the heating currents, by changing the amplitude of the heating currents or by setting the lengths of operating phases of the different groups of heating elements appropriately in a clocked operation. The amplitude change can be achieved by changing the pulse phase of control signals transmitted from the control unit 12 to the inverters 22*a*, 22*b*. In a step S2 the control unit 12 decides which of the abovementioned methods should be applied. The preference here is always the simultaneous changing of the frequency of the heating currents of both groups, as this allows interference in the form of humming to be avoided. Only if the required ratio of group heating powers is deficient by more than a tolerance range of for example 5% or 10% with the same heating frequency for both groups, are the group heating powers set by way of a clocked operation of the induction heating elements 10*a*-10*i*. In a step S3 the operating parameters are finally changed so that the group heating power changes in the direction of its setpoint value. The method then returns to step S1 to close the control circuit.

Figure 6:
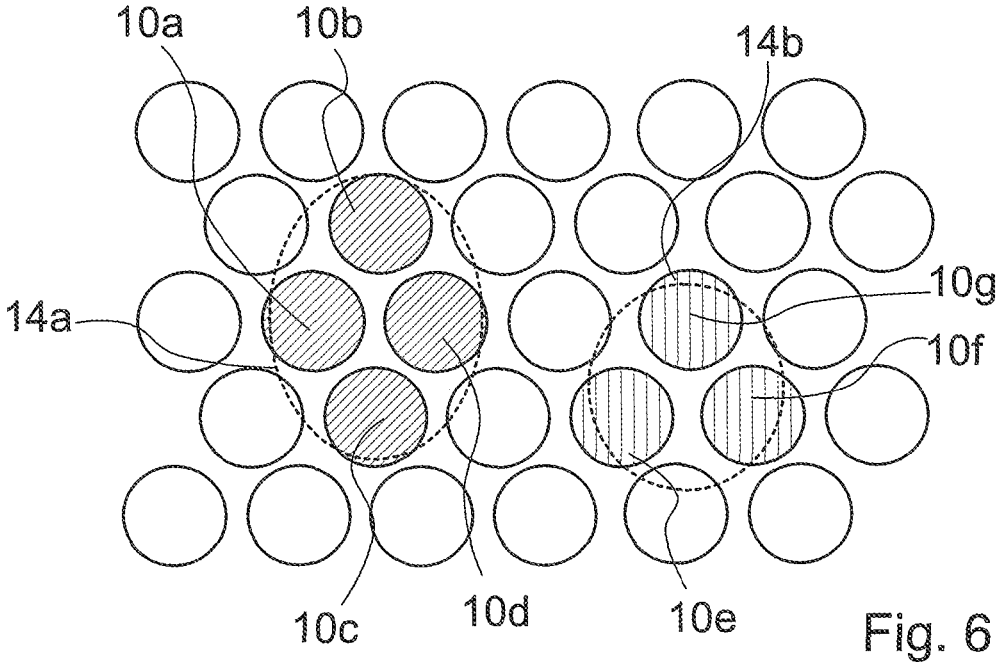
FIG. 6 shows a schematic diagram of two heating zones, the induction heating elements of which are supplied by a single inverter.

FIG. 6 shows a schematic diagram of two heating zones 14*a*, 14*b*, the induction heating elements 10*a*-10*d* or 10*e*-10*g* of which are operated by a single inverter 22 (not shown). The control unit 12 can only determine the input current of the inverter by way of a current sensor 18 and therefore the overall heating power of the two heating zones 14*a*, 14*b*, if both heating zones 14*a*, 14*b* are operated simultaneously.

Figure 7:
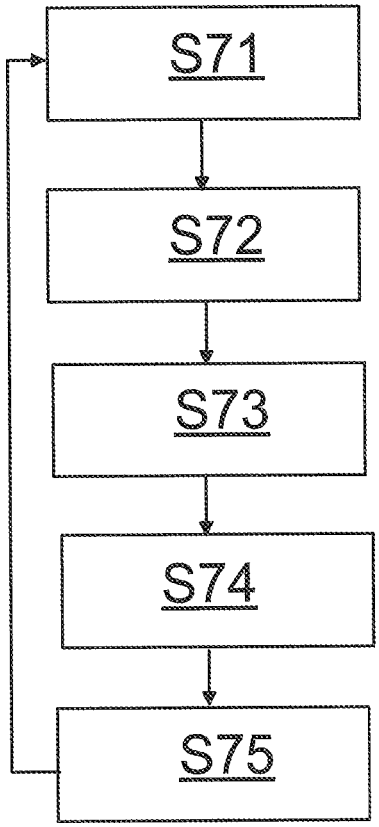
FIG. 7 shows a flow diagram of a method for distributing an overall heating power to the induction heating elements in the situation shown in FIG. 6

In order still to be able to determine the proportional heating powers of the two heating zones 14*a*, 14*b*, the control unit 12 uses a method illustrated schematically in FIG. 7. In a step S71 the control unit actuates the switching arrangement 36 to isolate the inductors 10*a*-10*d* of the first heating zone 14*a* from the inverter and uses the current sensor 18 assigned to the inverter to measure the heating power now consumed only by the second heating zone 14*b*. In a step S72 the control unit 12 closes the connection between the induction heating elements 10*a*-10*d* of the heating zone 14*a* and the inverter 22 again, by actuating the switching arrangement 36. The control unit 12 then uses the current sensor 18 again to measure the overall heating power now consumed by both heating zones 14*a*, 14*b*. The heating power of the second heating zone 14*b* is calculated in a step S73 by forming the difference between the overall heating power determined in step S72 and the heating power determined in step S71. In a step S74 the control unit forms the ratio of the heating powers of the individual heating zones 14*a*, 14*b* and compares it with a setpoint value. In the case of a clocked operation of the induction heating elements 10*a*-10*i* the control unit takes into account that the heating elements of the heating zones 14*a*, 14*b* are deactivated in phases and calculates a mean heating power. If there are deviations from the setpoint value, in a step S75 the control unit 12 changes the duration of the heating phases of the heating zones 14*a*, 14*b* so that the ratio changes in the direction of the setpoint value.

Figure 8:
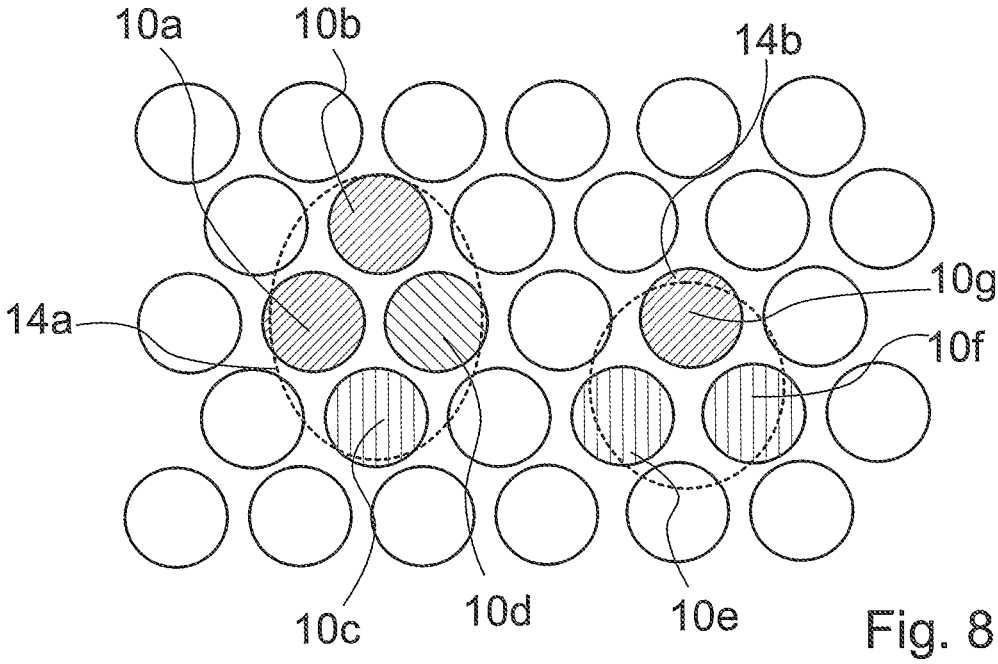
FIG. 8 shows a schematic diagram of two heating zones, the induction heating elements of which are supplied respectively by a number of inverters.

FIG. 8 shows a schematic diagram of two heating zones 14*a*, 14*b*, the induction heating elements 10*a*-10*g* of which are supplied respectively by a number of inverters. The induction heating elements assigned respectively to an inverter are shown with the same hatching in FIG. 8. The distribution of the overall heating power to the different heating zones 14*a*, 14*b* and to the different heating elements 10*a*-10*g* takes place by means of a combination of the methods shown in FIGS. 5 and 7. In order to determine the proportion of the overall heating power represented by a first heating zone 14*a*, the second heating zone 14*b* is briefly deactivated. The input currents of each inverter are measured, so that the distribution of the overall heating power of both heating zones 14*a*, 14*b* to the different inverters is known directly.

LIST OF REFERENCE CHARACTERS

10 Induction heating element
10*a* Induction heating element
10*b* Induction heating element
10*c* Induction heating element
10*d* Induction heating element
10*e* Induction heating element
12 Control unit
13 Heating zone
14 Measurement array
18*a* Current sensor
18*b* Current sensor
20*a* Driver unit
20*b* Driver unit
22*a* Inverter
22*b* Inverter
24 Rectifier
26 Diagram
28 Household power grid
30 Filter
32 Diagram
34*b* Current sensor
34*a* Current sensor
36 Switching arrangement
P Heating power
Pi Heating power
I Current
I1 Current
I2 Current

The invention claimed is:

1. An induction hob, comprising:

a plurality of induction heating elements;

a control unit to operate the plurality of induction heating elements so as to heat at least one flexibly definable heating zone in a synchronized manner; and a measurement array to measure a heating power generated by the plurality of induction heating elements;

wherein the measurement array is designed to measure a sum of respective heating powers of at least two of the plurality of induction heating elements; and wherein the control unit is programmed to use the sum of the respective heating powers to regulate the heating power generated by the plurality of induction heating elements.

2. The induction hob of claim 1, wherein the measurement array comprises at least one current sensor to measure a sum of currents flowing through the at least two of the plurality of induction heating elements.

3. The induction hob of claim 2, wherein the at least one current sensor is designed to measure an input current of an inverter that supplies the at least two of the plurality of induction heating elements.

4. The induction hob of claim 1, further comprising a plurality of inverters to generate an alternating current voltage to supply the plurality of induction heating elements, wherein the measurement array comprises a plurality of current sensors to measure a respective input current of each of the plurality of inverters.

5. The induction hob of claim 1, further comprising a plurality of driver units assigned respectively to each of the plurality of induction heating elements, each of the plurality of driver units comprising a respective inverter to generate a high-frequency current for operating the plurality of induction heating elements, wherein the measurement array is designed to measure a sum of input powers of the plurality of driver units.

6. The induction hob of claim 1, wherein the measurement array is designed to measure values of currents flowing through individual ones of the plurality of induction heating elements.

7. The induction hob of claim 6, wherein the control unit is programmed to use the values of the currents to limit an inverter power.

8. The induction hob of claim 6, wherein the control unit is programmed to use the sum of the respective heating powers of the at least two of the plurality of induction heating elements to regulate the heating power, if the at least two of the plurality of induction heating elements are assigned to a common heating zone, and wherein the values of the currents are used to regulate the respective heating powers of the at least two of the plurality induction heating elements, if the at least two of the plurality of induction heating elements are assigned to different heating zones.

9. The induction hob of claim 1, wherein the at least two of the plurality of induction heating elements are adjacent induction heating elements in a matrix of induction heating elements.

10. The induction hob of claim 1, wherein the measurement array is designed to measure the sum of the respective heating powers of at least four adjacent ones of the plurality of induction heating elements.

11. The induction hob of claim 1, wherein the control unit is programmed to form a heating zone from a plurality of groups of induction heating elements and to supply each of the plurality of groups from a different inverter, and wherein the control unit is structured to use respective input currents of the different inverters as a characteristic variable for the sum of the respective heating powers of the induction heating elements supplied by a relevant one of the different inverters.

12. The induction hob of claim 1, wherein the control unit is programmed to operate a plurality of groups of induction heating elements with a single inverter in at least one operating state and to determine a proportion of an overall heating power contributed by one of the plurality of groups in a phase in which only respective induction heating elements of the one group are active.

13. The induction hob of claim 1, wherein the control unit is programmed to operate a plurality of groups of induction heating elements simultaneously in at least one operating state.

14. The induction hob of claim 1, wherein the control unit is programmed to operate a plurality of groups of induction heating elements with a single inverter and to generate different heating powers by means of a short-term periodic deactivation of at least one of the plurality of induction heating elements.

15. A method for operating an induction hob having a plurality of induction heating elements, which are grouped flexibly to form a heating zone, the method comprising: measuring a heating power generated by the plurality of induction heating elements; utilizing the heating power to regulate operation of the plurality of induction heating elements; measuring a sum of respective heating powers of at least two of the plurality of induction heating elements; and utilizing the sum of the respective heating powers as a control variable for operating the at least two of the plurality of induction heating elements.

16. An induction hob, comprising:

a plurality of induction heating elements;

a control unit to operate the plurality of induction heating elements so as to heat at least one flexibly definable heating zone in a synchronized manner; and a measurement array to measure a heating power generated by the plurality of induction heating elements;

wherein the measurement array is designed to measure a sum of respective heating powers of at least two adjacent ones of the plurality of induction heating elements that reside in a common heating zone; and wherein the control unit is programmed to regulate the heating power generated by the plurality of induction heating elements based on the sum of the respective heating powers measured by the measurement array, without the need to measure individual heating powers of the heating elements.

17. The induction hob of claim 16, wherein the measurement array comprises at least one current sensor to measure a sum of currents flowing through the at least two of the plurality of induction heating elements.

18. The induction hob of claim 17, wherein the at least one current sensor is designed to measure an input current of an inverter that supplies the at least two of the plurality of induction heating elements.

19. The induction hob of claim 16, further comprising a plurality of inverters to generate an alternating current voltage to supply the plurality of induction heating elements, wherein the measurement array comprises a plurality of current sensors to measure a respective input current of each of the plurality of inverters.

20. The induction hob of claim 16, further comprising a plurality of driver units assigned respectively to each of the plurality of induction heating elements, each of the plurality of driver units comprising a respective inverter to generate a high-frequency current for operating the plurality of induction heating elements, wherein the measurement array is designed to measure a sum of input powers of the plurality of driver units.

21. The induction hob of claim 16, wherein the measurement array is designed to measure values of currents flowing through individual ones of the plurality of induction heating elements.

22. The induction hob of claim 21, wherein the control unit is designed to use the values of the currents to limit an inverter power.

23. The induction hob of claim 21, wherein the control unit is designed to use the sum of the respective heating powers of the at least two of the plurality of induction heating elements to regulate the heating power, only if the at least two of the plurality of induction heating elements are assigned to the common heating zone, and wherein the values of the currents are used to regulate the respective heating powers of the at least two of the plurality induction heating elements, if the at least two of the plurality of induction heating elements are assigned to different heating zones.

24. The induction hob of claim 16, wherein the at least two of the plurality of induction heating elements are adjacent induction heating elements in a matrix of induction heating elements.

25. The induction hob of claim 16, wherein the measurement array is designed to measure the sum of the respective heating powers of at least four adjacent ones of the plurality of induction heating elements.

26. The induction hob of claim 16, wherein the control unit is designed to form a heating zone from a plurality of groups of induction heating elements and to supply each of the plurality of groups from a different inverter, and wherein the control unit is structured to use respective input currents of the different inverters as a characteristic variable for the sum of the respective heating powers of the induction heating elements supplied by a relevant one of the different inverters.

27. The induction hob of claim 16, wherein the control unit is designed to operate a plurality of groups of induction heating elements with a single inverter in at least one operating state and to determine a proportion of an overall heating power contributed by one of the plurality of groups in a phase in which only respective induction heating elements of the one group are active.

28. The induction hob of claim 16, wherein the control unit is designed to operate a plurality of groups of induction heating elements simultaneously in at least one operating state.

29. The induction hob of claim 16, wherein the control unit is designed to operate a plurality of groups of induction heating elements with a single inverter and to generate different heating powers by means of a short-term periodic deactivation of at least one of the plurality of induction heating elements.

* * * * *

UNITED STATES PATENT AND TRADEMARK OFFICE

CERTIFICATE OF CORRECTION

PATENT NO. : 8,558,148 B2
APPLICATION NO. : 12/811553
DATED : October 15, 2013
INVENTOR(S) : Artigas Maestre et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 328 days.

Signed and Sealed this
Fifteenth Day of September, 2015

Michelle K. Lee

Michelle K. Lee
*Director of the United States Patent and Trademark Office*